US010310398B2

(12) United States Patent
Sugahara

(10) Patent No.: US 10,310,398 B2
(45) Date of Patent: Jun. 4, 2019

(54) POSITIVELY CHARGEABLE TONER

(71) Applicant: KYOCERA Document Solutions Inc., Osaka (JP)

(72) Inventor: Masanori Sugahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/117,913

(22) Filed: Aug. 30, 2018

(65) Prior Publication Data

US 2019/0072868 A1 Mar. 7, 2019

(30) Foreign Application Priority Data

Sep. 5, 2017 (JP) ..... 2017-170312

(51) Int. Cl.

| | |
|---|---|
| ***G03G 9/087*** | (2006.01) |
| *G03G 9/09* | (2006.01) |
| *G03G 9/097* | (2006.01) |

(52) U.S. Cl.

CPC ..... *G03G 9/08755* (2013.01); *G03G 9/08782* (2013.01); *G03G 9/0904* (2013.01); *G03G 9/09741* (2013.01); *G03G 9/09758* (2013.01)

(58) Field of Classification Search

CPC ..... G03G 9/08755; G03G 9/08782; G03G 9/09758; G03G 9/0904; G03G 9/09741

See application file for complete search history.

(56) References Cited

FOREIGN PATENT DOCUMENTS

| | | | |
|---|---|---|---|
| JP | 01296259 | * | 11/1989 |
| JP | 2016-004229 A | | 1/2016 |

* cited by examiner

*Primary Examiner* — Thorl Chea

(74) *Attorney, Agent, or Firm* — Studebaker & Brackett PC

(57) ABSTRACT

A positively chargeable toner includes a plurality of toner particles. The toner particles each include a toner mother particle and an external additive attached to a surface of the toner mother particle. The toner mother particle contains a binder resin and a wax. The external additive includes a plurality of antioxidant particles. Each of the antioxidant particles includes a base particle containing an antioxidant and having a surface treated with a surface treatment agent. The surface treatment agent has a first functional group and a second functional group in a molecule thereof. The first functional group has stronger positive chargeability than the base particle. The second functional group has stronger hydrophobicity than the base particle.

10 Claims, No Drawings

POSITIVELY CHARGEABLE TONER

INCORPORATION BY REFERENCE

The present application claims priority under 35 U.S.C. § 119 to Japanese Patent Application No. 2017-170312, filed on Sep. 5, 2017. The contents of this application are incorporated herein by reference in their entirety.

BACKGROUND

The present disclosure relates to a positively chargeable toner.

In some image formation on a recording medium using toner, a toner image transferred to the recording medium is fixed to the recording medium through heating. In recent years, reduction of thermal energy generated in fixing of an image to a recording medium (hereinafter referred to as "fixing energy") is required in order to increase printing speed and reduce a load on environment.

SUMMARY

A positively chargeable toner according to the present disclosure includes a plurality of toner particles. The toner particles each include a toner mother particle and an external additive attached to a surface of the toner mother particle. The toner mother particle contains a binder resin and a wax. The external additive includes a plurality of antioxidant particles. Each of the antioxidant particles includes a base particle containing an antioxidant and having a surface treated with a surface treatment agent. The surface treatment agent has a first functional group and a second functional group in a molecule thereof. The first functional group has stronger positive chargeability than the base particle. The second functional group has stronger hydrophobicity than the base particle.

DETAILED DESCRIPTION

The following describes an embodiment of the present disclosure in detail. Note that evaluation results (values indicating shape, physical properties, or the like) for particles are number averages of values measured for a suitable number of average particles selected from evaluation target particles, unless otherwise stated. Examples of particles include toner mother particles, an external additive, and a toner. The term toner mother particle refers to a toner particle including no external additive.

A number average particle diameter of particles is a number average value of equivalent circle diameters of primary particles (diameters of circles having the same areas as projected areas of the particles) measured using a microscope, unless otherwise stated. A value for a volume median diameter ($D_{50}$) of particles is measured based on the Coulter principle (electrical sensing zone method) using "Coulter Counter Multisizer 3" manufactured by Beckman Coulter, Inc., unless otherwise stated.

A value for a glass transition point (Tg) and a value for a melting point (Mp) are each measured using a differential scanning calorimeter ("DSC-6220" manufactured by Seiko Instruments Inc.), unless otherwise stated. A value for a softening point (Tm) is measured using a capillary rheometer ("CFT-500D" manufactured by Shimadzu Corporation), unless otherwise stated. A value for a thermal decomposition temperature is measured using a thermogravimetric-differential thermal analyzer (TG-DTA), unless otherwise stated.

The term thermal decomposition temperature refers to a temperature at a point on a plotted TG-DTA curve at which the mass of a sample begins to decrease due to thermal decomposition of the sample.

Strength of chargeability refers to a degree of chargeability in triboelectric charging, unless otherwise stated. A toner can be triboelectrically charged for example when the toner is mixed and stirred with a standard carrier (anionic property: N-01, cationic property: P-01) provided by The Imaging Society of Japan. A surface potential of toner particles is measured for example using a kelvin probe force microscope (KFM) before and after triboelectric charging. A portion having a larger variation in potential between before and after the triboelectric charging has stronger chargeability.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Also, the term "(meth)acryl" is used as a generic term encompassing both acryl and methacryl.

A positively chargeable toner according to the present embodiment is an electrostatic latent image developing toner suitably usable for development of electrostatic latent images. The positively chargeable toner according to the present embodiment can be used as a one-component developer. Alternatively, a two-component developer may be prepared with the positively chargeable toner and a carrier. When the positively chargeable toner is used as a one-component developer, the positively chargeable toner is positively charged through friction with a development sleeve or a toner charging member within a development device. Examples of the toner charging member include a doctor blade. When the positively chargeable toner constitutes a two-component developer, the positively chargeable toner is positively charged through friction with a carrier within a development device.

The positively chargeable toner according to the present embodiment can be used for image formation for example in an electrophotographic apparatus (image forming apparatus). The following describes an example of image formation methods performed by an electrophotographic apparatus.

First, an electrostatic latent image is formed on a photosensitive layer of a photosensitive drum based on image data. Next, the formed electrostatic latent image is developed with the positively chargeable toner (development step). In the development step, a development device supplies positively chargeable toner on a development sleeve to the photosensitive layer of the photosensitive drum and causes the positively chargeable toner to be attached to the electrostatic latent image by electric force. As a result, the electrostatic latent image is developed to form a toner image on the photosensitive layer of the photosensitive drum. Subsequently, the toner image is transferred to a recording medium (for example, paper) and the unfixed toner image is then fixed to the recording medium through heating (fixing step). As a result, an image is formed on the recording medium.

[Basic Features of Positively Chargeable Toner]

The positively chargeable toner according to the present embodiment has the following basic features. Specifically, the positively chargeable toner according to the present embodiment includes a plurality of toner particles. The toner particles each include a toner mother particle and an external additive attached to a surface of the toner mother particle. The toner mother particle contains a binder resin and a wax. The external additive includes a plurality of antioxidant particles. Each of the antioxidant particles includes a base particle containing an antioxidant and having a surface treated with a surface treatment agent. The surface treatment agent has a first functional group and a second functional group in a molecule thereof. The first functional group has stronger positive chargeability than the base particle. The second functional group has stronger hydrophobicity than the base particle. In the following description, the first functional group will be referred to as a "positively chargeable functional group". Also, the second functional group will be referred to as a "hydrophobic group".

As described above, the positively chargeable toner according to the present embodiment includes the antioxidant particles as an external additive. As a result of the above, in image formation with the positively chargeable toner according to the present embodiment, the antioxidant is preferentially oxidized as compared with a low-melting material contained in the positively chargeable toner (thermal decomposition of the antioxidant). Therefore, volatilization and thermal decomposition of the low-melting material can be prevented during the image formation. For example, even when the positively chargeable toner is exposed to high temperature during image formation, volatilization and thermal decomposition of the low-melting material can be prevented. As a result, the number of ultrafine particles (UFPs) to be produced can be reduced.

Further, the antioxidant particles are externally added to the toner mother particles in the present embodiment. In this configuration, the number of to-be-produced UFPs can be effectively reduced. Specifically, examples of low-melting materials contained in the positively chargeable toner include a wax. In general, a wax functions as a releasing agent (material added to a toner for ensuring sufficient releasability of the toner from a fixing device) by exuding to the surfaces of the toner mother particles from the inside thereof in the fixing step. Accordingly, in a configuration in which the antioxidant particles are externally added to the toner mother particles, the antioxidant particles and the wax tend to be present close to each other in the fixing step. Therefore, even when the unfixed toner image is fixed to the recording medium through heating, it is possible to prevent a chain reaction of oxidation and decomposition of the wax from occurring in the fixing step. As a result, production of a low molecular weight compound (for example, an oxide of the wax) can be prevented and production of a substance that readily volatilizes can be prevented. Thus, the number of to-be-produced UFPs can be effectively reduced.

Further, the base particles of the antioxidant particles each have a surface treated with the surface treatment agent. The surface treatment agent as used herein has the positively chargeable functional group and the hydrophobic group in a molecule thereof. Accordingly, the surfaces of the base particles of the antioxidant particles are subjected to a treatment to improve positive chargeability and hydrophobicity. Therefore, even when the positively chargeable toner according to the present embodiment is used for continuous image formation over a long period of time in a high temperature and high humidity environment, hydrophobicity of surfaces of the antioxidant particles tends to be maintained and consequently hydrophobicity of surfaces of the toner particles tends to be maintained. As a result, charge decay of the positively chargeable toner according to the present embodiment can be prevented even when the toner is used for continuous image formation over a long period of time in a high temperature and high humidity environment. Therefore, image density of equal to or higher than a specific value can be attained even when the positively chargeable toner according to the present embodiment is used for continuous image formation over a long period of time in a high temperature and high humidity environment. Also, scattering of oppositely charged toner can be prevented even when the positively chargeable toner according to the present embodiment is used for continuous image formation over a long period of time in a high temperature and high humidity environment.

The inventor initially assumed that it would be possible to obtain a positively chargeable toner through use of which the number of to-be-produced UFPs can be reduced and that has improved chargeability by treating the surfaces of the base particles with a surface treatment agent having a positively chargeable functional group in a molecule thereof (hereinafter referred to as an "assumption X"). However, considerable decrease in an amount of charge of a positively chargeable toner designed based on the assumption X has been confirmed after continuous image formation with the toner over a long period of time in a high temperature and high humidity environment. The inventor considered reasons for the above as follows.

Specifically, a positively chargeable functional group has relatively strong hydrophilicity in general. Therefore, in image formation with the positively chargeable toner designed based on the assumption X, it is difficult to maintain hydrophobicity of the surfaces of the base particles and consequently it is difficult to maintain hydrophobicity of the surfaces of the toner particles. It is particularly difficult to maintain hydrophobicity of the surfaces of the toner particles when the positively chargeable toner designed based on the assumption X is used in image formation in a high temperature and high humidity environment. Based on the above analysis, the inventor further continued study. As a result, the inventor found that it is possible through use of the positively chargeable toner having the above-described basic features to simultaneously achieve reduction in fixing energy and the number of to-be-produced UFPs and prevention of decrease in an amount of charge of the toner in a high temperature and high humidity environment.

[Preferable Features of Antioxidant Particles]

The base particles of the antioxidant particles each have a surface treated with the surface treatment agent. The surface of the base particle of each antioxidant particle may be chemically modified with the surface treatment agent (as in the case of first antioxidant particles described below). Alternatively, the surface treatment agent may be attached to at least part of the surface of the base particle by physical force (as in the case of second antioxidant particles described below). The base particles preferably contain the antioxidant, and more preferably contain the antioxidant only. The following describes the antioxidant and the surface treatment agent, and then describes the first antioxidant particles and the second antioxidant particles in order.

<Antioxidant>

The base particles are preferably produced with an antioxidant that is in a solid state at normal temperature. The above facilitates production of the base particles and eventually production of the antioxidant particles. Examples of antioxidants that are in a solid state at normal temperature and that can be preferably used include an antioxidant having a melting point of at least 30° C. Use of a colorless and transparent antioxidant that is in a solid state at normal temperature brings an advantage of development of the color of the positively chargeable toner being not impeded by the antioxidant.

Examples of antioxidants include amine antioxidants, phenol antioxidants, and phosphite antioxidants. An amine antioxidant has an amino group in a molecule thereof. The amino group has relatively strong positive chargeability. A phenol antioxidant has a phenol group in a molecule thereof. The phenol group has relatively strong negative chargeability. A phosphite antioxidant has a phosphorous atom in a molecule thereof. Here, it is noted that the surfaces of the base particles of the antioxidant particles are subjected to a treatment to improve positive chargeability and hydrophobicity. Therefore, a toner having excellent positive chargeability can be obtained even in a configuration in which the antioxidant (antioxidant contained in the base particles) does not have a positively chargeable functional group. A toner having excellent positive chargeability can be obtained even in a configuration for example in which the antioxidant (antioxidant contained in the base particles) has a negatively chargeable functional group (see Examples 2 and 3 described below). Therefore, not only amine antioxidants but also phenol antioxidants and phosphite antioxidants can be used in the present embodiment. Specific examples of antioxidants will be described later.

<Surface Treatment Agent>

The surface treatment agent has a positively chargeable functional group and a hydrophobic group in a molecule thereof. The positively chargeable functional group preferably includes a nitrogen atom and more preferably is an amino group. The hydrophobic group is preferably a hydrocarbon group optionally substituted with a substituent. More specifically, the surface treatment agent is preferably an alkoxysilane having an amino group in a molecule thereof (hereinafter referred to as an "aminoalkoxysilane") or a reactive silicone oil having an amino group in a molecule thereof (hereinafter referred to as an "amino modified silicone oil").

The aminoalkoxysilane is represented by formula (1-1) shown below. In formula (1-1), $R^{11}$ and $R^{12}$ each represent, independently of each other, a hydrogen atom or an alkyl group optionally substituted with a substituent, and preferably represent a hydrogen atom. $R^{13}$ represents an alkylene group optionally substituted with a substituent, preferably represents an alkylene group, and more preferably represents an alkylene group having a carbon number of at least 1 and no greater than 5. $R^{13}$ is equivalent to the hydrophobic group. $R^{14}$, $R^{15}$, and $R^{16}$ each represent, independently of one another, an alkyl group optionally substituted with a substituent, preferably represent an alkyl group, and more preferably represent an alkyl group having a carbon number of at least 1 and no greater than 5. In an aminoalkoxysilane used in Examples described later, $R^{11}$ and $R^{12}$ each represent a hydrogen atom, $R^{13}$ represents a propylene group, and $R^{14}$, $R^{15}$, and $R^{16}$ each represent an ethyl group.

(1-1)

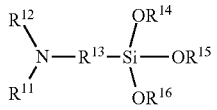

The amino modified silicone oil is represented by formula (1-2) shown below. In formula (1-2), $R^{21}$, $R^{22}$, $R^{23}$, $R^{24}$, $R^{25}$, $R^{26}$, $R^{27}$, $R^{28}$, and $R^{29}$ each represent, independently of one another, an alkyl group optionally substituted with a substituent. $R^{21}$ and $R^{29}$ each preferably represent, independently of each other, an alkyl group, and more preferably represent an alkyl group having a carbon number of at least 1 and no greater than 5. L represents a divalent organic group. Note that an organic group is a group including at least a carbon atom. L preferably represents a divalent organic group having a carbon number of at least 1 and no greater than 30, more preferably represents an alkanediyl group having a carbon number of at least 1 and no greater than 10 and optionally substituted with a substituent, and further preferably represents an alkanediyl group having a carbon number of at least 1 and no greater than 5. Each of $R^{22}$, $R^{23}$, $R^{24}$, $R^{25}$, $R^{26}$, $R^{27}$, and $R^{28}$ (hereinafter referred to as "each of $R^{22}$ to $R^{28}$") preferably represents an alkyl group, and more preferably represents a methyl group. Each of $R^{22}$ to $R^{28}$ is equivalent to the hydrophobic group. $n_{21}$ and $n_{22}$ each represent, independently of each other, an integer of at least 1. $n_{21}$ and $n_{22}$ each preferably represent, independently of each other, an integer of at least 1 and no greater than 100, and more preferably represent an integer of at least 10 and no greater than 100. In an amino modified silicone oil used in Examples described later, each of $R^{21}$ to $R^{29}$ represents a methyl group.

(1-2)

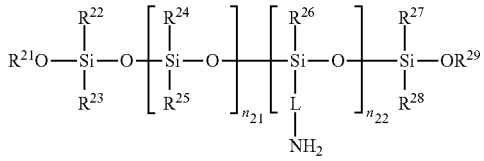

<First Antioxidant Particles>

The base particles of the first antioxidant particles each have a surface chemically modified with the surface treatment agent. The first antioxidant particles tend to be obtained in a situation in which the antioxidant (antioxidant contained in the base particles) includes a reactive moiety in a molecule thereof. The reactive moiety refers to a part that is reactive with the surface treatment agent. The following describes examples where a surface treatment agent having an alkoxy group in a molecule thereof (for example, the aminoalkoxysilane represented by formula (1-1) or the amino modified silicone oil represented by formula (1-2)) is used. The alkoxy group is formed into a hydroxyl group (—OH group) through hydrolysis. Therefore, the reactive moiety is preferably a part that is reactive with the hydroxyl group to cause a dehydration reaction. More specifically, the reactive moiety is preferably a derivative (—$CH_2O$—) of a methylol group or a hydroxyl group. Examples of preferable antioxidants including a reactive moiety in a molecule thereof include phenol antioxidants and phosphite antioxidants. The reactive moiety of a phenol antioxidant is a hydroxyl group derived from a phenol group. Examples of preferable phosphite antioxidants including a reactive moiety in a molecule thereof include a compound represented by formula (3-2) shown below. The reactive moiety of the compound represented by formula (3-2) is a derivative (—$CH_2O$—) of a methylol group.

In a case where the surface treatment agent is the aminoalkoxysilane or the amino modified silicone oil, a modification group that chemically modifies the surfaces of the base particles (hereinafter simply referred to as a "modification group") includes a siloxane bond (—Si—O—Si—), a positively chargeable functional group, and a hydrophobic group. Preferably, a silicon atom included in the siloxane bond (hereinafter simply referred to as a "silicon atom") is directly or indirectly bonded to an atom constituting the base particles. Preferably, the positively chargeable functional group is directly or indirectly bonded to the silicon atom. Preferably, the hydrophobic group is directly or indirectly bonded to the silicon atom.

The following describes the modification group in a case where the surface treatment agent is aminoalkoxysilane and the antioxidant is a phenol antioxidant. In this case, when the surfaces of the base particles are treated with the surface treatment agent, alkoxy groups included in the aminoalkoxysilane (more specifically, groups $OR^{14}$, $OR^{15}$, and $OR^{16}$) are formed into hydroxyl groups through hydrolysis. Among the hydroxyl groups generated through the hydrolysis, some are bonded together to form a silanol bond and another reacts (dehydration reaction) with a phenol group of the antioxidant (see chemical equation S-1 shown below). The surfaces of the base particles are chemically modified with the surface treatment agent through the dehydration reaction. Accordingly, the modification group is represented by formula (2-1) shown below.

$$\text{—Si—OH+Ph-OH} \rightarrow \text{—Si—O-Ph+H}_2\text{O} \qquad \text{chemical equation S-1}$$

In formula (2-1) shown below, $R^{11}$, $R^{12}$, and $R^{13}$ are the same as those described above. x represents an integer of at least 1. An available bond of an oxygen atom is bonded to an atom constituting the base particles. Therefore, in the modification group, a silicon atom is directly bonded to an oxygen atom not included in the siloxane bond and the same oxygen atom (oxygen atom not included in the siloxane bond) is directly bonded to the atom constituting the base particles. Accordingly, the silicon atom is indirectly bonded to the atom constituting the base particles. Also, in the modification group, the positively chargeable functional group is directly bonded to $R^{13}$, which is directly bonded to the silicon atom. Accordingly, the positively chargeable functional group is indirectly bonded to the silicon atom. Also, in the modification group, the hydrophobic group (more specifically, $R^{13}$) is directly bonded to the silicon atom.

(2-1)

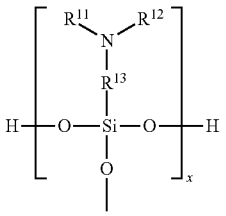

The following describes a modification group in a case where the surface treatment agent is an amino modified silicone oil and the antioxidant is a phenol antioxidant. In this case, when the surfaces of the base particles are treated with the surface treatment agent, alkoxy groups included in the amino modified silicone oil (more specifically, groups $OR^{21}$ and $OR^{29}$) are formed into hydroxyl groups through hydrolysis. Some of the hydroxyl groups generated through the hydrolysis reacts (dehydration reaction) with a phenol group of the antioxidant (see chemical equation S-1 shown above). The surfaces of the base particles are chemically modified with the surface treatment agent through the dehydration reaction. Therefore, in the modification group, a silicon atom is directly bonded to an oxygen atom not included in the siloxane bond and the same oxygen atom (oxygen atom not included in the siloxane bond) is directly bonded to an atom constituting the base particles. Accordingly, the silicon atom is indirectly bonded to the atom constituting the base particles. Also, in the modification group, the positively chargeable functional group (more specifically, an amino group) is indirectly bonded to a silicon atom (see formula (1-2) shown above). Also, in the modification group, the hydrophobic group (more specifically, each of $R^{22}$ to $R^{28}$) is directly bonded to a silicon atom (see formula (1-2) shown above).

The following describes a modification group in a case where the surface treatment agent is aminoalkoxysilane and the antioxidant includes a derivative (—$CH_2O$—) of a methylol group in a molecule thereof. In this case, when the surfaces of the base particles are treated with the surface treatment agent, the alkoxy groups included in the aminoalkoxysilane (specifically, the groups $OR^{14}$, $OR^{15}$, and $OR^{16}$) are formed into hydroxyl groups through hydrolysis. Among the hydroxyl groups generated through the hydrolysis, some are bonded together to form a silanol bond and another reacts (dehydration reaction) with the derivative (—$CH_2O$—) of the methylol group included in the antioxidant (see chemical equation S-2 shown below). The surfaces of the base particles are chemically modified with the surface treatment agent through the dehydration reaction. Accordingly, the modification group is represented by formula (2-2) shown below.

$$\text{—Si—OH+—CH}_2\text{O} \rightarrow \text{—Si—CHO—+H}_2\text{O} \qquad \text{chemical equation S-2}$$

In formula (2-2), $R^{11}$, $R^{12}$, and $R^{13}$ are the same as those described above. y represents an integer of at least 1. A carbon atom and a hydrogen atom and an oxygen atom that are directly bonded to the carbon atom are each derived from the derivative (—$CH_2O$—) of the methylol group. Accordingly, in the modification group, a silicon atom is directly bonded to an atom constituting the base particles (more specifically, the carbon atom). Also, in the modification group, the positively chargeable functional group is directly bonded to $R^{13}$, which is directly bonded to the silicon atom. Accordingly, the positively chargeable functional group is indirectly bonded to the silicon atom. Also, in the modification group, the hydrophobic group (more specifically, $R^{13}$) is directly bonded to the silicon atom.

(2-2)

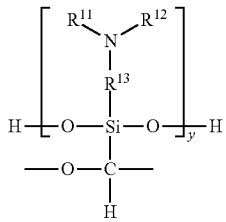

The following describes a modification group in a case where the surface treatment agent is an amino modified silicone oil and the antioxidant includes a derivative (—$CH_2O$—) of a methylol group in a molecule thereof. In this case, when the surfaces of the base particles are treated with the surface treatment agent, the alkoxy groups included in the amino modified silicone oil (more specifically, the groups $OR^{21}$ and $OR^{29}$) are formed into hydroxyl groups through hydrolysis. Some of the hydroxyl groups generated through the hydrolysis reacts (dehydration reaction) with the derivative (—$CH_2O$—) of the methylol group included in the antioxidant (see chemical equation S-2 shown above). The surfaces of the base particles are chemically modified with the surface treatment agent through the dehydration reaction. Accordingly, in the modification group, a silicon atom is directly bonded to an atom constituting the base particles. Also, in the modification group, the positively chargeable functional group (more specifically, an amino group) is indirectly bonded to a silicon atom (see formula (1-2) shown above). Also, in the modification group, the hydrophobic group (more specifically, each of $R^{22}$ to $R^{28}$) is directly bonded to a silicon atom (see formula (1-2) shown above).

Note that the modification group has a dimension of about several nanometers (more specifically, no greater than 5 nm) in a radial direction of each base particle. Therefore, even if the surfaces of the base particles are chemically modified with the modification group, the number of to-be-produced UFPs can be reduced in the presence of the antioxidant (antioxidant contained in the base particles) (see Examples 1 to 4 described below).

<Second Antioxidant Particles>

In each of the second antioxidant particles, the surface treatment agent is attached to at least part of the surface of the base particle by physical force. The surfaces of the base particles of the second antioxidant particles are treated with the surface treatment agent through attachment of the surface treatment agent to the surfaces of the base particles by physical force, as described above. The second antioxidant particles tend to be obtained in a situation in which the antioxidant (antioxidant contained in the base particles) includes no reactive moiety in a molecule thereof. The reactive moiety is as described above in <First Antioxidant Particles>. Examples of preferable antioxidants including no reactive moiety in a molecule thereof include amine antioxidants.

Note that the surface treatment agent has a dimension of about several nanometers (more specifically, no greater than 5 nm) in the radial direction of each base particle. Therefore, even if the surface treatment agent is attached to the surfaces of the base particles by physical force, the number of to-be-produced UFPs can be reduced in the presence of the antioxidant (antioxidant contained in the base particles) (see Examples 1 to 4 described below).

[Examples of Materials of Positively Chargeable Toner]

<Toner Mother Particle>

The toner mother particles contain a binder resin and a wax. The toner mother particles may further contain at least one of a colorant and a charge control agent. The toner mother particles may contain an antioxidant. In a configuration in which the toner mother particles contain an antioxidant, the number of to-be-produced UFPs can be effectively reduced. The antioxidant optionally contained in the toner mother particles may be an amine antioxidant, a phenol antioxidant, or a phosphite antioxidant.

(Binder Resin)

The binder resin is usually a main component (for example, at least 85% by mass) of the toner mother particles. Accordingly, properties of the binder resin are thought to have a great influence on overall properties of the toner mother particles.

Properties of the binder resin (specific examples include hydroxyl value, acid value, glass transition point, and softening point) can be adjusted through use of different resins in combination as the binder resin. For example, in a configuration in which the binder resin has an amino group or an amide group, the toner mother particles have a strong tendency to be cationic.

Preferably, the binder resin includes a thermoplastic resin. Examples of thermoplastic resins that can be used include polyester resins, styrene-based resins, acrylic acid-based resins, olefin-based resins, vinyl resins, polyamide resins, and urethane resins. Examples of acrylic acid-based resins that can be used include polymers of acrylic acid esters and polymers of methacrylic acid esters. Examples of olefin-based resins that can be used include polyethylene resins and polypropylene resins. Examples of vinyl resins that can be used include vinyl chloride resins, polyvinyl alcohols, vinyl ether resins, and N-vinyl resins. Copolymers of the above-listed resins, that is, copolymers formed by introduction of a repeating unit into the above-listed resins can also be used as thermoplastic resins for forming the toner particles. For example, a styrene-acrylic acid-based resin or a styrene-butadiene-based resin can also be used as a thermoplastic resin constituting the binder resin.

Preferably, the binder resin includes a resin having a low softening point (Tm) (hereinafter referred to as a "LTm resin") among the above-listed resins. More preferably, the binder resin is constituted by the LTm resin. Examples of LTm resins include a resin having a softening point of lower than 100° C. The above can result in further reduction in the fixing energy. Note that the binder resin may further include a resin having a high softening point (hereinafter referred to as a "HTm resin"). Even in some configuration in which the binder resin further includes the HTm resin, further reduction in the fixing energy can be achieved. Examples of HTm resins include a resin having a softening point of equal to or higher than 100° C. A thermoplastic resin having a softening point of equal to or higher than 100° C. is preferable as the HTm resin. The following describes in detail a polyester resin, which is an example of the binder resin.

(Binder Resin: Polyester Resin)

A polyester resin is a copolymer of at least one alcohol and at least one carboxylic acid. Examples of alcohols that can be used for synthesis of the polyester resin include dihydric alcohols and tri- or higher-hydric alcohols listed below. Examples of dihydric alcohols that can be used include diols and bisphenols. Examples of carboxylic acids that can be used for synthesis of the polyester resin include dibasic carboxylic acids and tri- or higher-basic carboxylic acids listed below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkanedicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkanedicarboxylic acids include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexane dicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Wax)

The wax is used for example in order to improve fixability or hot offset resistance of the positively chargeable toner. In order to increase cationic strength of the toner mother particles, the toner mother particles are preferably produced with a cationic wax.

In order to achieve further reduction in the fixing energy, the wax preferably has a low melting point (Mp). A typical wax contained in a positively chargeable toner has a melting point of lower than 100° C. Therefore, a known material used as a wax contained in a positively chargeable toner can be used in the present embodiment with no specific limitation placed on the material.

Examples of preferable waxes include aliphatic hydrocarbon waxes, plant waxes, animal waxes, mineral waxes, waxes containing a fatty acid ester as a main component, and waxes in which a fatty acid ester is partially or entirely deoxidized. Examples of preferable aliphatic hydrocarbon waxes include low molecular weight polyethylene, low molecular weight polypropylene, polyolefin copolymer, polyolefin wax, microcrystalline wax, paraffin wax, and Fischer-Tropsch wax. Oxides of these waxes are also included in the aliphatic hydrocarbon waxes. Examples of preferable plant waxes include candelilla wax, carnauba wax, Japan wax, jojoba wax, and rice wax. Examples of preferable animal waxes include beeswax, lanolin, and spermaceti. Examples of preferable mineral waxes include ozokerite, ceresin, and petrolatum. Examples of preferable waxes containing a fatty acid ester as a main component include montanic acid ester wax and castor wax. A wax may be used alone or a plurality of waxes may be used in combination.

(Charge Control Agent)

A charge control agent is used for example in order to improve charge stability or a charge rise characteristic of the positively chargeable toner. The charge rise characteristic of the positively chargeable toner is an indicator as to whether or not the positively chargeable toner can be charged to a specific charge level in a short period of time. Cationic strength of the toner mother particles can be increased through a positively chargeable charge control agent (positive charge control agent) contained in the toner mother particles.

Examples of positive charge control agents include azine compounds, direct dyes made from azine compounds, nigrosine compounds, acid dyes made from nigrosine compounds, and quaternary ammonium salts. Examples of azine compounds include pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline. Examples of direct dyes made from azine compounds include Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL. Examples of nigrosine compounds include nigrosine, nigrosine salts, and nigrosine derivatives. Examples of acid dyes made from nigrosine compounds include Nigrosine BK, Nigrosine NB, and Nigrosine Z. Examples of quaternary ammonium salts include benzyldecylhexylmethyl ammonium chloride and decyltrimethyl ammonium chloride. Metal salts of naphthenic acid, metal salts of higher fatty acids, alkoxylated amines, and alkyl amides can also be used as positive charge control agents. A positive charge control agent may be used alone or a plurality of positive charge control agents may be used in combination.

(Colorant)

A known pigment or dye that matches the color of the positively chargeable toner can be used as a colorant. The amount of the colorant is preferably at least 1 part by mass and no greater than 20 parts by mass relative to 100 parts by mass of the binder resin in order to form high quality images with the positively chargeable toner.

The toner mother particles may contain a black colorant. Examples of black colorants include carbon black. Alternatively, a colorant adjusted to a black color using a yellow colorant, a magenta colorant, and a cyan colorant may be used as a black colorant.

The toner mother particles may contain a non-black colorant such as a yellow colorant, a magenta colorant, or a cyan colorant.

A yellow colorant that can be used is for example at least one compound selected from the group consisting of condensed azo compounds, isoindolinone compounds, anthraquinone compounds, azo metal complexes, methine compounds, and arylamide compounds. Specific examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

A magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

A cyan colorant that can be used is for example at least one compound selected from the group consisting of copper phthalocyanine compounds, anthraquinone compounds, and basic dye lake compounds. Specific examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

<External Additive>

<Antioxidant Particles>

The external additive includes a plurality of antioxidant particles. The amount of the antioxidant particles is preferably at least 0.1 parts by mass and no greater than 10.0 parts by mass relative to 100.0 parts by mass of the toner mother particles, and more preferably at least 0.5 parts by mass and no greater than 5.0 parts by mass. An excessively small amount of the antioxidant particles may result in failure to effectively reduce the number of to-be-produced UFPs. An excessively large amount of the antioxidant particles tends to result in a high coverage ratio of the antioxidant particles (i.e., a ratio of an area of each toner mother particle covered by the antioxidant particles out of a surface area of the toner mother particle) to excessively increase a particle diameter of the toner particle. The above may cause reduction in fixing strength.

A number average primary particle diameter of the antioxidant particles is preferably at least 10 nm and no greater than 500 nm, and more preferably at least 50 nm and no greater than 200 nm. An excessively small number average primary particle diameter of the antioxidant particles may cause embedment of the antioxidant particles in the toner mother particles. An excessively large number average primary particle diameter of the antioxidant particles may cause detachment of the antioxidant particles from the surfaces of the toner mother particles. Also, an excessively large number average primary particle diameter of the antioxidant particles tends to result in a high coverage ratio of the antioxidant particles, which may cause reduction in fixing strength.

The following specifically describes the antioxidant contained in the base particles.

As described above, the antioxidant contained in the base particles is preferably an amine antioxidant that is in a solid state at normal temperature, a phenol antioxidant that is in a solid state at normal temperature, or a phosphite antioxidant that is in a solid state at normal temperature.

Examples of preferable amine antioxidants that are in a solid state at normal temperature include naphthylamine antioxidants, phenylenediamine antioxidants, diphenylamine antioxidants, phenothiazine antioxidants, and quinoline antioxidants.

Examples of preferable naphthylamine antioxidants include 1-naphthylamine, N-phenyl-1-naphthylamine, p-octylphenyl-1-naphthylamine, p-nonylphenyl-1-naphthylamine, p-dodecylphenyl-1-naphthylamine, and N-phenyl-2-naphthylamine.

Examples of preferable phenylenediamine antioxidants include N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-(1,3-dimethylbutyl)-N'-phenyl-p-phenylenediamine, N,N'-dioctyl-p-phenylenediamine, phenylhexyl-p-phenylenediamine, and phenyloctyl-p-phenylenediamine. A commercially available phenylenediamine antioxidant that can be used is "ANTAGE (registered Japanese trademark) 6C" manufactured by Kawaguchi Chemical Industry Co., Ltd.

Examples of preferable diphenylamine antioxidants include diphenylamine, dipyridylamine, p,p'-di-n-butyldiphenylamine, p,p'-di-t-butyldiphenylamine, p,p'-di-t-pentyldiphenylamine, p,p'-dioctyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimethylbenzoyl) diphenylamine, p-isopropoxydiphenylamine, 4-isopropylaminodiphenylamine, and di(octylphenyl) amine. Di(octylphenyl)amine includes two aromatic rings in a molecule thereof. In each of the two aromatic rings, one hydrogen atom constituting the aromatic ring is substituted with a $—C_8H_{17}$ group. The $—C_8H_{17}$ groups may each be located, independently of each other, at any of a para position, an ortho position, and a meta position relative to an amino group. Examples of di(octylphenyl)amine include di(4-octylphenyl)amine. Commercially available diphenylamine antioxidants that can be used are "ANTAGE 3C" and "ANTAGE LDA" manufactured by Kawaguchi Chemical Industry Co., Ltd. "ANTAGE LDA" manufactured by Kawaguchi Chemical Industry Co., Ltd. contains di(octylphenyl)amine.

Examples of preferable phenothiazine antioxidants include phenothiazine, N-methylphenothiazine, N-ethylphenothiazine, 3,7-dioctylphenothiazine, phenothiazine carboxylic acid ester, and 10H-phenoselenazine. A commercially available phenothiazine antioxidant that can be used is "ANTAGE STDP-N" manufactured by Kawaguchi Chemical Industry Co., Ltd.

Examples of preferable quinoline antioxidants include poly(2,2,4-trimethyl-1,2-dihydroquinoline). A commercially available quinoline antioxidant that can be used is "ANTAGE RD" manufactured by Kawaguchi Chemical Industry Co., Ltd.

Examples of preferable phenol antioxidants that are in a solid state at normal temperature include cresol antioxidants and hydroquinone antioxidants.

Examples of preferable cresol antioxidants include 4,4'-butylidene bis(6-tert-butyl-m-cresol), 2,2'-methylene bis(6-tert-butyl-p-cresol), 2,2'-methylene bis(6-tert-butyl-4-ethylphenol), 4,4'-thiobis(6-tert-butyl-m-cresol), and 2,6-di-tert-butyl-p-cresol. Commercially available cresol antioxidants that can be used are "ANTAGE W-300", "ANTAGE W-400", "ANTAGE W-500", "ANTAGE CRYSTAL", and "ANTAGE BHT" manufactured by Kawaguchi Chemical Industry Co., Ltd. "ANTAGE BHT" manufactured by Kawaguchi Chemical Industry Co., Ltd. contains 2,6-di-tert-butyl-p-cresol. More specifically, "ANTAGE BHT" manufactured by Kawaguchi Chemical Industry Co., Ltd. contains a compound represented by formula (3-1) shown below.

(3-1)

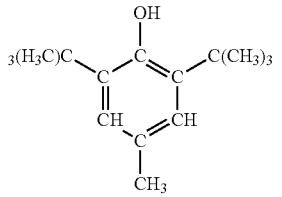

Examples of preferable hydroquinone antioxidants include 2,5-di-tert-amylhydroquinone and 2,5-di-tert-butylhydroquinone. Commercially available hydroquinone antioxidants that can be used are "ANTAGE DAH" and "ANTAGE DBH" manufactured by Kawaguchi Chemical Industry Co., Ltd.

Examples of preferable phosphite antioxidants that are in a solid state at normal temperature include "ADKSTAB (registered Japanese trademark) PEP-8" manufactured by ADEKA Corporation. "ADKSTAB PEP-8" manufactured by ADEKA Corporation contains a compound represented by formula (3-2) shown below. In formula (3-2), $R^{31}$ and $R^{32}$ each represent a straight-chain alkyl group having a carbon number of 18.

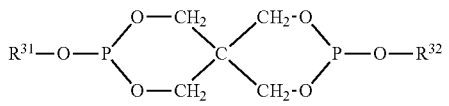

(3-2)

(Additional External Additive Particles)

The external additive may further include particles containing no antioxidant (additional external additive particles). In order to improve fluidity of the toner particles or ease of handling of the toner, it is preferable to externally add additional external additive particles to the toner mother particles. Preferably, the additional external additive particles are at least one type of particles selected from the group consisting of silica particles and particles of metal oxides. Examples of preferable metal oxides constituting the particles of metal oxides include alumina, titanium oxide, magnesium oxide, zinc oxide, strontium titanate, and barium titanate. The particle diameter of the additional external additive particles is preferably at least 0.01 μm and no greater than 1.00 μm. The amount of the additional external additive particles is preferably at least 0.5 parts by mass and no greater than 10.0 parts by mass relative to 100 parts by mass of the toner mother particles.

The additional external additive particles are each preferably attached to the surface of the toner mother particle, but may alternatively be disposed on the surface of the toner mother particle with the antioxidant particle interposed therebetween. When the toner mother particles, the antioxidant particles, and the other external additive particles are mixed, an external additive particle having a relatively small particle diameter (for example, a silica particle) can thread through adjacent antioxidant particles to reach the surface of the toner mother particle. However, an external additive particle having a relatively large particle diameter (for example, a titanium oxide particle) hardly threads through adjacent antioxidant particles, and therefore, hardly reaches the surface of the toner mother particle. Accordingly, external additive particles having a relatively large particle diameter are hardly attached to the surfaces of the toner mother particles and tend to be disposed on the surfaces of the toner mother particles with the antioxidant particles interposed therebetween.

[Example of Method for Producing Positively Chargeable Toner]

A method for producing the positively chargeable toner according to the present embodiment preferably includes for example production of the toner mother particles, preparation of the antioxidant particles, and mixing. Note that toner particles produced at the same time are thought to have substantially the same structure as one another.

<Production of Toner Mother Particles>

The following describes a pulverization method, which is an example of methods for producing the toner mother particles.

Specifically, a binder resin and a wax are initially mixed to prepare a toner material. At this time, at least one of a colorant and a charge control agent may be further used for preparation of the toner material. Also, an antioxidant may be further used for preparation of the toner material. Alternatively, the toner material may be prepared without using an antioxidant.

Next, the toner material is melt-kneaded using a melt-kneader (for example, a single-screw or twin-screw extruder). The resultant melt-kneaded product is cooled to room temperature and then pulverized and classified at room temperature. Through the above, the toner mother particles are obtained.

In a situation in which an antioxidant is used for preparation of the toner material, the antioxidant is thermally decomposed when the toner material is melt-kneaded at a temperature equal to or higher than a thermal decomposition temperature of the antioxidant (for example, a temperature higher than 120° C.). When the antioxidant is thermally decomposed, the antioxidant is difficult to exert the effect of reducing the number of to-be-produced UFPs. Therefore, the toner material is preferably melt-kneaded at a temperature lower than the thermal decomposition temperature of the antioxidant. For example, a temperature for the melt-kneading is preferably set within a range from 90° C. to 120° C.

In a situation in which the antioxidant is not used for preparation of the toner material, the toner material can be melt-kneaded at a temperature equal to or higher than the thermal decomposition temperature of the antioxidant. In this situation, the temperature for the melt-kneading is preferably determined taking dispersibility of the wax in the toner mother particles and a spreading property of the toner into account. For example, the temperature for the melt-kneading is preferably set within a range from 90° C. to 150° C.

<Preparation of Antioxidant Particles>

In preparation of the antioxidant particles, surfaces of base particles are treated with a surface treatment agent. Specifically, the base particles are initially prepared. Preferably, base particles having a number average primary particle diameter of at least 10 nm and no greater than 500 nm are prepared. More preferably, base particles having a number average primary particle diameter of at least 50 nm and no greater than 200 nm are prepared. Base particles may be prepared by pulverizing a commercially available antioxidant.

Next, the surface treatment agent is applied onto the surfaces of the base particles. For example, the surface treatment agent is preferably sprayed toward the base particles under stirring.

Subsequently, the base particles including the surface treatment agent attached to the surfaces thereof are heated to a specific temperature, and then the temperature of the base particles is kept at the specific temperature for a specific period of time. In a situation in which the antioxidant contained in the base particles includes a reactive moiety in a molecule thereof, the reactive moiety and the surface treatment agent react with each other while the temperature of the base particles is kept at the specific temperature for the specific period of time. As a result, the first antioxidant particles are obtained. In a situation in which the antioxidant contained in the base particles includes no reactive moiety in a molecule thereof, the surface treatment agent dries out at the surfaces of the base particles while the temperature of the base particles is kept at the specific temperature for the specific period of time. As a result, the second antioxidant particles are obtained. The specific temperature is preferably selected from for example a range from 50° C. to 100° C. The specific period of time is preferably selected from for example a range from 30 minutes to 200 minutes.

<Mixing>

In mixing, the toner mother particles and the antioxidant particles are mixed using a mixer (for example, an FM mixer). The toner mother particles may be mixed with either or both of the first antioxidant particles and the second antioxidant particles. The toner mother particles may be mixed with the antioxidant particles and additional external additive particles.

Examples

The following describes Examples of the present disclosure. Table 1 shows toners (positively chargeable toners) TA-1 to TA-4 and TB-1 to TB-5 according to Examples and Comparative Examples. In Table 1, a number average primary particle diameter of each type of first external additive particles is shown in the column under the heading "Particle diameter" below "First external additive particles". A number average primary particle diameter of second external additive particles is shown in the column under the heading "Particle diameter" below "Second external additive particles". A number average primary particle diameter of third external additive particles is shown in the column under the heading "Particle diameter" below "Third external additive particles". Toner mother particles M-1 were produced without using an antioxidant. The toners TB-1 and TB-5 were produced without using first external additive particles.

TABLE 1

| | Toner mother particles | | External additive particles | | | | | |
|---|---|---|---|---|---|---|---|---|
| | | | First external additive particles | | Second external additive particles | | Third external additive particles | |
| Toner | Type | Anti-oxidant | Type | Particle diameter (nm) | Material | Particle diameter (nm) | Material | Particle diameter (nm) |
| TA-1 | M-1 | Not used | P-4 | 103 | Silica | 12 | Titanium oxide | 35 |
| TA-2 | M-1 | Not used | P-5 | 103 | Silica | 12 | Titanium oxide | 35 |
| TA-3 | M-1 | Not used | P-6 | 103 | Silica | 12 | Titanium oxide | 35 |
| TA-4 | M-1 | Not used | P-7 | 103 | Silica | 12 | Titanium oxide | 35 |
| TB-1 | M-1 | Not used | Not used | — | Silica | 12 | Titanium oxide | 35 |
| TB-2 | M-1 | Not used | P-1 | 100 | Silica | 12 | Titanium oxide | 35 |
| TB-3 | M-1 | Not used | P-2 | 100 | Silica | 12 | Titanium oxide | 35 |
| TB-4 | M-1 | Not used | P-3 | 100 | Silica | 12 | Titanium oxide | 35 |
| TB-5 | M-2 | Used | Not used | — | Silica | 12 | Titanium oxide | 35 |

Table 2 shows first external additive particles P-1 to P-7 used in Examples and Comparative Examples. In Table 2, "Amine" represents an amine antioxidant. "Phenol" represents a phenol antioxidant. "Phosphite" represents a phosphite antioxidant. In each type of the first external additive particles P-1 to P-3, surfaces of base particles were not treated with a surface treatment agent. By contrast, in each type of the first external additive particles P-4 to P-7, surfaces of base particles were treated with a surface treatment agent.

TABLE 2

| First external additive particles | | | |
|---|---|---|---|
| Type | Base particles | Surface treatment | Surface treatment agent |
| P-1 | Amine | Not performed | — |
| P-2 | Phenol | Not performed | — |
| P-3 | Phosphite | Not performed | — |
| P-4 | Amine | Performed | Aminoalkoxysilane |
| P-5 | Phenol | Performed | Aminoalkoxysilane |
| P-6 | Phenol | Performed | Amino modified silicone oil |
| P-7 | Phosphite | Performed | Aminoalkoxysilane |

The following first describes production methods for the first external additive particles P-1 to P-7 used in Examples and Comparative Examples and methods for measuring physical property values thereof. Next, production methods for toner mother particles M-1 and M-2 used in Examples and Comparative Examples will be described. Then, production methods for the toners TA-1 to TA-4 and TB-1 to TB-5 according to Examples and Comparative Examples, evaluation methods and evaluation results thereof will be described in order. In evaluations in which error might occur, an evaluation value was calculated by calculating the arithmetic mean of an appropriate number of measurement values so that any error was sufficiently small. Also, a transmission electron microscope (TEM) was used for measurement of a number average particle diameter.

[Production Method for First External Additive Particles]

<Production Method for First External Additive Particles P-1>

First, 500 g of an amine antioxidant ("ANTAGE LDA" manufactured by Kawaguchi Chemical Industry Co., Ltd.) was pulverized using a supersonic jet mill ("PJM-80SP" manufactured by Nippon Pneumatic Mfg. Co., Ltd.). The resultant pulverized product was classified using an air classifier ("Elbow Jet Type EJ-LABO" manufactured by Nittetsu Mining Co., Ltd.). Through the above, the first external additive particles P-1 were obtained.

<Production Method for First External Additive Particles P-2>

A phenol antioxidant ("ANTAGE BHT" manufactured by Kawaguchi Chemical Industry Co., Ltd.) was used instead of the amine antioxidant. The first external additive particles P-2 were obtained by the same production method as that for the first external additive particles P-1 in all aspects other than the above.

<Production Method for First External Additive Particles P-3>

A phosphite antioxidant ("ADKSTAB PEP-8" manufactured by ADEKA Corporation) was used instead of the amine antioxidant. The first external additive particles P-3 were obtained by the same production method as that for the first external additive particles P-1 in all aspects other than the above.

<Production Method for First External Additive Particles P-4>

First, 100 g of the first external additive particles P-1 was placed in a fluidized bed within a vibratory fluidized bed device ("Vibratory Fluidized Bed Device Type VUA-15" manufactured by CHUO KAKOHKI CO., LTD.). Nitrogen was supplied to the fluidized bed to fluidize the first external additive particles P-1 within the fluidized bed. Then, 3 g of ion exchanged water was sprayed into the fluidized bed while fluidizing the first external additive particles P-1, and the first external additive particles P-1 were then fluidized for further 10 minutes. Subsequently, 4 g of γ-aminopropyltriethoxysilane (product of Tokyo Kagaku Kogyo Co., Ltd.) was sprayed into the fluidized bed and particles were then fluidized for 15 minutes. The particles were the first external additive particles P-1 with γ-aminopropyltriethoxysilane attached to surfaces thereof.

The temperature within the fluidized bed was increased up to 70° C. The above particles were fluidized for 120 minutes while the temperature within the fluidized bed was kept at 70° C. and nitrogen was supplied to the fluidized bed. The resultant powder was pulverized using a supersonic jet mill ("PJM-80SP" manufactured by Nippon Pneumatic Mfg. Co., Ltd.). The resultant pulverized product was classified using an air classifier ("Elbow Jet Type EJ-LABO" manufactured by Nittetsu Mining Co., Ltd.). Through the above, the first external additive particles P-4 were obtained.

<Production Method for First External Additive Particles P-5>

The first external additive particles P-2 were used instead of the first external additive particles P-1. The first external additive particles P-5 were produced by the same production method as that for the first external additive particles P-4 in all aspects other than the above.

<Production Method for First External Additive Particles P-6>

Instead of 4 g of γ-aminopropyltriethoxysilane, 3 g of an amino modified silicone oil ("Reactive Silicone Oil KF-857" manufactured by Shin-Etsu Chemical Co., Ltd.) was used. The first external additive particles P-6 were produced by the same production method as that for the first external additive particles P-5 in all aspects other than the above.

<Production Method for First External Additive Particles P-7>

The first external additive particles P-3 were used instead of the first external additive particles P-1. The first external additive particles P-7 were produced by the same production method as that for the first external additive particles P-4 in all aspects other than the above.

[Measurement Method of Number Average Primary Particle Diameter of First External Additive Particles]

With respect to each type of the first external additive particles P-1 to P-7, the first external additive particles were observed using a transmission electron microscope (TEM, "H-7100FA" manufactured by Hitachi High-Technologies Corporation) at a magnification of 1,000,000× and TEM photographs of at least 100 particles among the first external additive particles were captured. TEM photographs of 100 particles were arbitrarily selected from the captured TEM photographs. Equivalent circle diameters were measured in the arbitrarily selected TEM photographs using image analysis software ("WinROOF" manufactured by Mitani Corporation). A number average value of the measured equivalent circle diameters was calculated. The calculated number average value was determined to be a number average primary particle diameter of the first external additive particles. Calculation results are shown in Table 1.

Note that each type of the first external additive particles P-1 to P-7 had a sharp particle size distribution. More specifically, the first external additive particles P-1 substantially included only amine antioxidant particles having a particle diameter of approximately 100 nm. The first external additive particles P-2 substantially included only phenol antioxidant particles having a particle diameter of approximately 100 nm. The first external additive particles P-3 substantially included only phosphite antioxidant particles having a particle diameter of approximately 100 nm. Each type of the first external additive particles P-4 to P-7 substantially included only antioxidant particles having a particle diameter of approximately 103 nm.

[Production Method for Toner Mother Particles]

<Production Method for Toner Mother Particles M-1>

An FM mixer ("FM-10B" manufactured by Nippon Coke & Engineering Co., Ltd.) was charged with 87.0 parts by mass of a polyester resin ("POLYESTER (registered Japanese trademark) HP-313" manufactured by The Nippon Synthetic Chemical Industry Co., Ltd.), 3.0 parts by mass of a carbon black ("MA100" manufactured by Mitsubishi Chemical Corporation), 2.0 parts by mass of a charge control agent (nigrosine dye: "BONTRON (registered Japanese trademark) N-71" manufactured by ORIENT CHEMICAL INDUSTRIES, Co., Ltd.), 4.0 parts by mass of a charge control agent ("ACRYBASE (registered Japanese trademark) FCA-201-PS" manufactured by FUJIKURA KASEI CO., LTD.), and 4.0 parts by mass of an ester wax ("NISSAN ELECTOL (registered Japanese trademark) WEP-4" manufactured by NOF Corporation). Contents of the FM mixer were mixed using the FM mixer at a rotational speed of 2,400 rpm. Through the above, a toner material was obtained.

The obtained toner material was melt-kneaded using a twin-screw extruder ("TEM-26SS" manufactured by TOSHIBA MACHINE CO., LTD.) under conditions of a material feeding rate of 5 kg/hour, a shaft rotational speed of 160 rpm, and a set temperature (cylinder temperature, equivalent to a melt-kneading temperature) of 130° C. The resultant melt-kneaded product was pulverized using a pulverizer ("ROTOPLEX Type 16/8" manufactured by former TOA MACHINERY MFG.) under a condition of a set particle diameter of 2 mm. The resultant coarsely pulverized product was finely pulverized using a pulverizer ("Turbo Mill Type RS" manufactured by FREUND-TURBO CORPORATION). The resultant finely pulverized product was classified using a classifier ("Elbow Jet" manufactured by Nittetsu Mining Co., Ltd.). Through the above, the toner mother particles M-1 having a volume median diameter ($D_{50}$) of 7.0 μm were obtained.

<Production Method for Toner Mother Particles M-2>

The toner mother particles M-2 were produced by the same production method as that for the toner mother particles M-1 in all aspects other than that toner material was prepared by changing composition thereof as follows. Specifically, the amount of the polyester resin ("POLYESTER HP-313" manufactured by The Nippon Synthetic Chemical Industry Co., Ltd.) was changed from 87.0 parts by mass to 86.5 parts by mass. The amount of the ester wax ("NISSAN ELECTOL (registered Japanese trademark) WEP-4" manufactured by NOF Corporation) was changed from 4.0 parts by mass to 3.0 parts by mass. Further, 1.5 parts by mass of an amine antioxidant ("ANTAGE LDA" manufactured by Kawaguchi Chemical Industry Co., Ltd.) was further added into the FM mixer ("FM-10B" manufactured by Nippon Coke & Engineering Co., Ltd.).

[Production Method for Positively Chargeable Toners]

<Production Method for Toner TA-1>

An FM mixer ("FM-10B" manufactured by Nippon Coke & Engineering Co., Ltd.) was charged with 100.0 parts by mass of the toner mother particles M-1, 1.2 parts by mass of hydrophobic silica particles (second external additive particles, "AEROSIL (registered Japanese trademark) RA-200H" manufactured by Nippon Aerosil Co., Ltd.), 1.0 part by mass of titanium oxide particles (third external additive particles, "MT-500B" manufactured by TAYCA CORPORATION), and 1.5 parts by mass of the first external additive particles P-4. Contents of the FM mixer were mixed for 5 minutes using the FM mixer at a rotational speed of 3,500 rpm. Through the above, the toner TA-1 including a plurality of toner particles was obtained.

<Production Method for Toners TA-2 to TA-4>

The toners TA-2 to TA-4 were produced by the same production method as that for the toner TA-1 in all aspects other than that the first external additive particles P-5 to P-7 were used respectively instead of the first external additive particles P-4.

<Production Method for Toner TB-1>

The toner TB-1 was produced by the same production method as that for the toner TA-1 in all aspects other than that no first external additive particles were used.

<Production Method for Toners TB-2 to TB-4>

The toners TB-2 to TB-4 were produced by the same production method as that for the toner TA-1 in all aspects other than that the first external additive particles P-1 to P-3 were used respectively instead of the first external additive particles P-4.

<Production Method for Toner TB-5>

The toner TB-5 was produced by the same production method as that for the toner TB-1 in all aspects other than that the toner mother particles M-2 were used instead of the toner mother particles M-1.

[Evaluation Methods for Positively Chargeable Toners]

<Preparation of Evaluation Target>

First, 2 kg of an epoxy resin ("Epikote 1004" manufactured by Mitsubishi Chemical Corporation) was dissolved in 20 L of acetone, and 100 g of diethylene triamine and 150 g of phthalic anhydride were added thereto. A liquid mixture was obtained as above. The obtained liquid mixture and 10 kg of ferrite particles ("F51-50" manufactured by Powdertech Co., Ltd.) were loaded into a fluidized bed coating device ("SFC-5" manufactured by Freund Corporation). Surfaces of the ferrite particles were coated with the epoxy resin while hot air at 80° C. was introduced into the fluidized bed coating device. The resultant particles were loaded into a drier and heated at 180° C. for 1 hour within the drier. Through the above, a carrier including a plurality of carrier particles was obtained.

With respect to each of the toners TA-1 to TA-4 and TB-1 to TB-5, 100 parts by mass of the carrier and 8 parts by mass of the toner were loaded into a powder mixer ("ROCKING MIXER (registered Japanese trademark)" manufactured by AICHI ELECTRIC CO., LTD.). Contents of the mixer were stirred using the mixer for 30 minutes. Through the above, a two-component developer was obtained. The obtained two-component developer was used as an evaluation target.

<Preparation of Evaluation Apparatus>

The evaluation target (unused) was loaded into a development device of a multifunction peripheral ("TASKalfa 3510i" manufactured by KYOCERA Document Solutions Inc.). Also, a toner for replenishment use (unused) was loaded into a toner container of the multifunction peripheral. The same toner as that included in the evaluation target was used as the toner for replenishment use. That is, each of the toners TA-1 to TA-4 and TB-1 to TB-5 was used as the toner for replenishment use.

An evaluation apparatus was prepared as above.

<Evaluation of Number of Produced UFPs>

The evaluation apparatus was installed in a stainless steel chamber (environmental test chamber having a capacity of approximately 5 $m^3$), and the chamber was ventilated over 2 hours. Subsequently, the evaluation apparatus was used to perform a continuous printing test over 10 minutes. The number of UFPs produced during the continuous printing test (the number of produced UFPs) was measured using a particle size distribution meter ("Fast Mobility Particle Sizer (FMPS) 3091", manufactured by TSI Incorporated) in accordance with measurement conditions specified by an award criterion RAL-UZ171 of the German ecolabel "The Blue Angel" provided by the German Federal Ministry for the Environment, Nature Conservation and Nuclear Safety.

The number of produced UFPs was evaluated based on the following standard.

Evaluation results are shown in Table 3.

Good (G): The number of produced UFPs was smaller than $10.0\times10^{11}$.

Not good (NG): The number of produced UFPs was equal to or greater than $10.0\times10^{11}$.

<Evaluation of Amount of Charge of Toner, Image Density, and Toner Scattering Amount: Normal Temperature and Normal Humidity Environment>

First, a first evaluation image was printed on plain paper (A4 size) using the evaluation apparatus in an environment at a temperature of 23° C. and a relative humidity of 50% (normal temperature and normal humidity environment). The first evaluation image included a solid image portion and a blank portion (in which nothing was printed). Thereafter, an amount of charge of the toner was measured by a method described below and a measured value was determined to be an "initial amount of charge of the toner". Also, an image density of the first evaluation image was measured by a method described below and a measured value was determined to be an "initial image density".

Next, an image (printing rate: 5%) was continuously printed on 5,000 sheets of plain paper (A4 size) using the evaluation apparatus in an environment at a temperature of 23° C. and a relative humidity of 50% (normal temperature and normal humidity environment). After the continuous printing, a second evaluation image was printed on plain paper (A4 size) using the evaluation apparatus in the environment at a temperature of 23° C. and a relative humidity of 50% (normal temperature and normal humidity environment). The second evaluation image included a solid image portion and a blank portion (in which nothing was printed). Thereafter, an amount of charge of the toner was measured by the method described below and a measured value was determined to be an "amount of charge of the toner after continuous printing". Also, an image density of the second evaluation image was measured by the method described below and a measured value was determined to be an "image density after continuous printing". Further, a mass of toner accumulated on a toner receiving section of the development device of the evaluation apparatus (hereinafter referred to as a "toner scattering amount") was measured by a method described below.

The following describes the method for measuring an amount of charge of the toner. Specifically, first, the evaluation target was taken out of the development device of the evaluation apparatus. Next, 0.10 g of the evaluation target (more specifically, the two-component developer) was placed in a measurement cell of a Q/m meter ("MODEL 210HS-1" manufactured by TREK, INC.), and only the toner included in the evaluation target was sucked through a sieve (wire netting) for 10 seconds. Then, an amount of charge of the toner (unit: μC/g) was calculated based on the following equation.

Amount of charge of toner (unit: μC/g)=total electric amount (unit: μC) of sucked toner/mass (unit: g) of sucked toner The following describes the method for measuring an image density. Specifically, a reflection density (ID: image density) of the solid image portion of the first evaluation image was measured using a Macbeth reflection densitometer ("RD914" manufactured by X-Rite Inc.). Also, a reflection density (ID: image density) of the solid image portion of the second evaluation image was measured using the Macbeth reflection densitometer ("RD914" manufactured by X-Rite Inc.).

The following describes the method for measuring a toner scattering amount. Specifically, toner accumulated on the toner receiving section of the development device of the evaluation apparatus was sucked using a Q/m meter ("MODEL 210HS-1" manufactured by TREK, INC.). A mass of the sucked toner was measured using an electronic balance. The thus measured value was determined to be a toner scattering amount.

An amount of charge of the toner was evaluated based on the following standard. Evaluation results are shown in Table 3.

Good (G): The amount of charge of the toner was at least 12 μC/g and no greater than 27 μC/g.

Not good (NG): The amount of charge of the toner was smaller than 12 μC/g or greater than 27 μC/g.

An image density was evaluated based on the following standard. Evaluation results are shown in Table 3.

Good (G): The image density was equal to or higher than 1.20.

Not good (NG): The image density was lower than 1.20.

A toner scattering amount was evaluated based on the following standard. Evaluation results are shown in Table 3.

Good (G): The toner scattering amount was smaller than 200 mg.

Not good (NG): The toner scattering amount was equal to or greater than 200 mg.

<Evaluation of Amount of Charge of Toner, Image Density, and Toner Scattering Amount: High Temperature and High Humidity Environment>

An amount of charge of the toner, an image density, and a toner scattering amount in a high temperature and high humidity environment were evaluated by the same methods as those described above in <Evaluation of Amount of Charge of Toner, Image Density, and Toner Scattering Amount: Normal Temperature and Normal Humidity Environment> in all aspects other than that the evaluation was performed in an environment at a temperature of 30° C. and a relative humidity of 80% (high temperature and high humidity environment). Evaluation results are shown in Table 4.

[Evaluation Results for Positively Chargeable Toners]

Table 3 shows the evaluation results of the number of produced UFPs, and the evaluation results of the amount of charge of the toner, the image density, and the toner scattering amount in the normal temperature and normal humidity environment. Table 4 shows the evaluation results of the amount of charge of the toner, the image density, and the toner scattering amount in the high temperature and high humidity environment. In Table 3, the evaluation results of the number of produced UFPs are shown in the column under the heading "UFP". In each of Tables 3 and 4, the evaluation results of the amount of charge of the toner are shown in the column under the heading "Amount of charge", the evaluation results of the image density are shown in the column under the heading "Image density", and the evaluation results of the toner scattering amount are shown in the column under the heading "Scattering amount". In each of Tables 3 and 4, (G) represents "Good" and (NG) represents "Not good".

TABLE 3

| | | | Normal temperature normal and humidity environment | | | | |
|---|---|---|---|---|---|---|---|
| | | | Amount of charge (μC/g) | | Image density | | |
| | Toner | UFP ($\times 10^{11}$) | Initial | After continuous printing | Initial | After continuous printing | Scattering amount (mg) |
| Example 1 | TA-1 | 2.6 (G) | 25 (G) | 25 (G) | 1.23 (G) | 1.24 (G) | 98 (G) |
| Example 2 | TA-2 | 2.7 (G) | 26 (G) | 25 (G) | 1.22 (G) | 1.23 (G) | 95 (G) |
| Example 3 | TA-3 | 2.6 (G) | 26 (G) | 25 (G) | 1.22 (G) | 1.24 (G) | 97 (G) |
| Example 4 | TA-4 | 2.7 (G) | 25 (G) | 24 (G) | 1.24 (G) | 1.26 (G) | 97 (G) |

TABLE 3-continued

| | | | Normal temperature normal and humidity environment | | | | |
|---|---|---|---|---|---|---|---|
| | | | Amount of charge (μC/g) | | Image density | | |
| | Toner | UFP ($\times 10^{11}$) | Initial | After continuous printing | Initial | After continuous printing | Scattering amount (mg) |
| Comparative Example 1 | TB-1 | 23.2 (NG) | 27 (G) | 26 (G) | 1.22 (G) | 1.24 (G) | 90 (G) |
| Comparative Example 2 | TB-2 | 2.6 (G) | 19 (G) | 18 (G) | 1.32 (G) | 1.33 (G) | 121 (G) |
| Comparative Example 3 | TB-3 | 2.8 (G) | 14 (G) | 14 (G) | 1.39 (G) | 1.39 (G) | 208 (NG) |
| Comparative Example 4 | TB-4 | 2.7 (G) | 15 (G) | 14 (G) | 1.37 (G) | 1.38 (G) | 203 (NG) |
| Comparative Example 5 | TB-5 | 10.4 (NG) | 25 (G) | 24 (G) | 1.24 (G) | 1.26 (G) | 95 (G) |

TABLE 4

| | | High temperature and high humidity environment | | | | |
|---|---|---|---|---|---|---|
| | | Amount of charge (μC/g) | | Image density | | |
| | Toner | Initial | After continuous printing | Initial | After continuous printing | Scattering amount (mg) |
| Example 1 | TA-1 | 20 (G) | 16 (G) | 1.33 (G) | 1.36 (G) | 150 (G) |
| Example 2 | TA-2 | 21 (G) | 17 (G) | 1.32 (G) | 1.35 (G) | 159 (G) |
| Example 3 | TA-3 | 21 (G) | 16 (G) | 1.32 (G) | 1.35 (G) | 152 (G) |
| Example 4 | TA-4 | 20 (G) | 16 (G) | 1.33 (G) | 1.37 (G) | 151 (G) |
| Comparative Example 1 | TB-1 | 23 (G) | 19 (G) | 1.27 (G) | 1.33 (G) | 117 (G) |
| Comparative Example 2 | TB-2 | 14 (G) | 11 (NG) | 1.39 (G) | 1.42 (G) | 238 (NG) |
| Comparative Example 3 | TB-3 | 10 (NG) | 6 (NG) | 1.42 (G) | 1.44 (G) | 310 (NG) |
| Comparative Example 4 | TB-4 | 11 (NG) | 6 (NG) | 1.41 (G) | 1.44 (G) | 306 (NG) |
| Comparative Example 5 | TB-5 | 20 (G) | 16 (G) | 1.33 (G) | 1.37 (G) | 152 (G) |

Each of the toners TA-1 to TA-4 (toners according to Examples 1 to 4) had the above-described basic features. Specifically, each of the toners TA-1 to TA-4 included a plurality of toner particles. The toner particles each included a toner mother particle and an external additive attached to a surface of the toner mother particle. The toner mother particle contained a binder resin and a wax. The external additive included a plurality of antioxidant particles. The antioxidant particles each included a base particle containing an antioxidant and having a surface treated with a surface treatment agent. The surface treatment agent had a positively chargeable functional group and a hydrophobic group in a molecule thereof.

In image formation with any of the toners TA-1 to TA-4, the number of produced UFPs could be reduced to be smaller than a threshold value as shown in Tables 3 and 4. Also, in image formation with any of the toners TA-1 to TA-4 in the normal temperature and normal humidity environment, the initial amount of charge of the toner and the amount of charge of the toner after continuous printing were both within a desired range, and the initial image density and the image density after continuous printing were both equal to or higher than a desired value. Also, the toner scattering amount could be reduced to be smaller than a threshold value. Also, in image formation with any of the toners TA-1 to TA-4 in the high temperature and high humidity environment, the initial amount of charge of the toner and the amount of charge of the toner after continuous printing were both within the desired range, and the initial image density and the image density after continuous printing were both equal to or higher than the desired value. Also, the toner scattering amount could be reduced to be smaller than the threshold value.

By contrast, none of the toners TB-1 to TB-5 had the above-described basic features. Specifically, the toner TB-1 (toner according to Comparative Example 1) was produced without using an antioxidant. The number of UFPs produced in image formation with the toner TB-1 was considerably large when compared to that produced in image formation with any of the toners TA-1 to TA-4.

In the toner TB-2 (toner according to Comparative Example 2), the amine antioxidant particles, rather than antioxidant particles treated with a surface treatment agent having a positively chargeable functional group and a hydrophobic group in a molecule thereof, were externally added to the toner mother particles. In image formation with the toner TB-2 in the high temperature and high humidity environment, the amount of charge of the toner after continuous printing was smaller than the desired range and the toner scattering amount exceeded the threshold value after continuous printing.

In the toner TB-3 (toner according to Comparative Example 3), the phenol antioxidant particles, rather than antioxidant particles treated with a surface treatment agent having a positively chargeable functional group and a hydrophobic group in a molecule thereof, were externally added to the toner mother particles. In image formation with the toner TB-3 in the normal temperature and normal humidity environment, the toner scattering amount exceeded the threshold value after continuous printing. Also, in image formation with the toner TB-3 in the high temperature and high humidity environment, even the initial amount of charge of the toner was smaller than the desired range and the toner scattering amount exceeded the threshold value after continuous printing.

In the toner TB-4 (toner according to Comparative Example 4), the phosphite antioxidant particles, rather than antioxidant particles treated with a surface treatment agent having a positively chargeable functional group and a hydrophobic group in a molecule thereof, were externally added to the toner mother particles. Evaluation results for the toner TB-4 were similar to those for the toner TB-3.

In the toner TB-5 (toner according to Comparative Example 5), the antioxidant was internally added to the toner mother particles, but was not externally added thereto.

The number of UFPs produced in image formation with the toner TB-5 was considerably large as compared to that produced in image formation with any of the toners TA-1 to TA-4.

More specifically, evaluation results for each of the toners TB-2 to TB-4 were as follows.

In image formation with the toner TB-2 in the normal temperature and normal humidity environment, the toner had an amount of charge that was within the desired range even after continuous printing and the toner scattering amount was smaller than the threshold value even after continuous printing. However, in image formation with the toner TB-2 in the high temperature and high humidity environment, the toner had an amount of charge that was smaller than the desired range after continuous printing and the toner scattering amount exceeded the threshold value after continuous printing.

In image formation with either of the toners TB-3 and TB-4 in the normal temperature and normal humidity environment, the toner had an amount of charge that was within the desired range even after continuous printing. However, in image formation with either of the toners TB-3 and TB-4 in the normal temperature and normal humidity environment, the toner had an amount of charge smaller than that of the toner TB-2 measured in image formation with the toner TB-2 in the normal temperature and normal humidity environment.

Note that the inventor confirmed the following A and B.

A: The toners TA-1 to TA-4 were excellent in low-temperature fixability.

B: The number of produced UFPs further decreased when the toner mother particles M-2 were used instead of the toner mother particles M-1 in production of each of the toners TA-1 to TA-4.

What is claimed is:

1. A positively chargeable toner comprising a plurality of toner particles, wherein the toner particles each include a toner mother particle and an external additive attached to a surface of the toner mother particle, the toner mother particle containing a binder resin and a wax, the external additive includes a plurality of antioxidant particles, each of the antioxidant particles includes a base particle containing an antioxidant and having a surface treated with a surface treatment agent, the surface treatment agent has a first functional group and a second functional group in a molecule thereof, the first functional group has stronger positive chargeability than the base particle, and the second functional group has stronger hydrophobicity than the base particle.

2. The positively chargeable toner according to claim 1, wherein the surface of the base particle of each of the antioxidant particles is chemically modified with the surface treatment agent, and a modification group chemically modifying the surface of the base particle includes the first functional group and the second functional group.

3. The positively chargeable toner according to claim 2, wherein the surface treatment agent is an alkoxysilane having an amino group in a molecule thereof or a reactive silicone oil having an amino group in a molecule thereof, the modification group further includes a siloxane bond, a silicon atom included in the siloxane bond is directly or indirectly bonded to an atom constituting the base particle, the first functional group is an amino group directly or indirectly bonded to the silicon atom, and the second functional group is a hydrocarbon group optionally substituted with a substituent and directly or indirectly bonded to the silicon atom.

4. The positively chargeable toner according to claim 1, wherein in the base particle of each of the antioxidant particles, the surface treatment agent is attached to the surface of the base particle by physical force.

5. The positively chargeable toner according to claim 4, wherein the surface treatment agent is an alkoxysilane having an amino group in a molecule thereof or a reactive silicone oil having an amino group in a molecule thereof.

6. The positively chargeable toner according to claim 2, wherein the antioxidant contained in the base particle is a phenol antioxidant or a phosphite antioxidant.

7. The positively chargeable toner according to claim 4, wherein the antioxidant contained in the base particle is an amine antioxidant.

8. The positively chargeable toner according to claim 1, wherein the toner mother particle further contains an antioxidant.

9. The positively chargeable toner according to claim 3, wherein the alkoxysilane having the amino group in the molecule thereof is represented by a formula (1-1) shown below, (1-1)

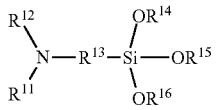

where in the formula (1-1), $R^{11}$ and $R^{12}$ each represent a hydrogen atom, $R^{13}$ represents a propylene group, and $R^{14}$, $R^{15}$, and $R^{16}$ each represent an ethyl group.

10. The positively chargeable toner according to claim 3, wherein the reactive silicone oil having the amino group in the molecule thereof is represented by a formula (1-2) shown below, (1-2)
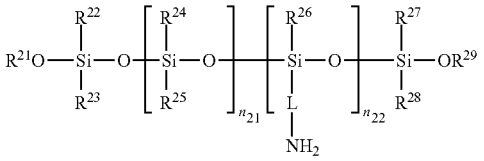
where in the formula (1-2), each of $R^{21}$ to $R^{29}$ represents a methyl group, $n_{21}$ and $n_{22}$ each represent, independently of each other, an integer of at least 1, and L represents a divalent organic group.
* * * * *